United States Patent [19]

Tweeton

[11] 4,228,908

[45] Oct. 21, 1980

[54] BABY BOTTLE CARRIER

[76] Inventor: Timothy J. Tweeton, 6808 N. 10th Pl., Phoenix, Ariz. 85014

[21] Appl. No.: 958,814

[22] Filed: Nov. 8, 1978

[51] Int. Cl.[2] ..... A45C 11/00; A61J 9/00

[52] U.S. Cl. ..... 215/11 C; 206/545; 215/12 A; 215/13 R; 220/23.83; 220/412; 220/902; 224/148

[58] Field of Search ..... 224/5 W, 5 R, 29 B, 224/5 V, 13, 15, 17, 20, 21, 148, 274, 908, 235; 220/255, 408, 410, DIG. 19, 444, 412, 902, 23.83; 215/12 A, 12 R, 13 R, 11 R, 11 C, 11 E; 206/545, 549

[56] References Cited

U.S. PATENT DOCUMENTS

| | | | |
|---|---|---|---|
| 1,325,859 | 12/1919 | Phillips | 215/11.3 C |
| 3,472,568 | 10/1969 | Southwick | 220/412 X |
| 3,730,374 | 5/1973 | Picciano et al. | 220/408 X |
| 3,757,983 | 9/1973 | McCarthy | 220/23.4 |
| 3,910,470 | 10/1975 | Swenson et al. | 224/5 V |
| 4,119,248 | 10/1978 | Butler et al. | 224/5 R X |
| 4,143,764 | 3/1979 | Moss | 220/23.83 |

FOREIGN PATENT DOCUMENTS

| | | | |
|---|---|---|---|
| 986812 | 8/1951 | France | 215/11 C |

*Primary Examiner*—Robert J. Spar
*Assistant Examiner*—Jerold M. Forsberg
*Attorney, Agent, or Firm*—Warren F. B. Lindsley

[57] ABSTRACT

Insulated baby bottle carrier employing conforming cavity or cavities for one or more bottles.

7 Claims, 13 Drawing Figures

BABY BOTTLE CARRIER

BACKGROUND OF THE INVENTION

This invention relates to carriers for baby bottles and more particularly to slim line insulated carriers that can be easily carried individually or fitted into bags used for carrying other baby and infant supplies.

PRIOR ART

No prior art relating to baby bottle carriers having baby bottle form fitting cavities for one or more bottles are known.

SUMMARY OF THE INVENTION

In accordance with the invention claimed a new and improved baby bottle carrier is provided which employs form fitting cavities to completely enclose the bottle, cap and nipple in a sanitary protective arrangement.

It is, therefore one object of this invention to provide a new and improved insulated carrier for baby bottles which provides a form fitting cavity for the bottle, cap and extended nipple.

Another object of this invention is to provide an improved slim line insulating carrier for receiving baby bottles in conforming cavities with their nipples extended wherein the cover of the carrier telescopically fits into the base of the carrier.

A further object of this invention is to provide an improved slim line baby bottle carrier having bottle conforming cavities wherein individual bottle portions of the carrier may be detachably connected to the remaining portions.

A still further object of this invention is to provide a slim line carrier having conforming cavities for baby bottles wherein the bottles are vertically arranged one above the other in separately detachable portions of the carrier.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
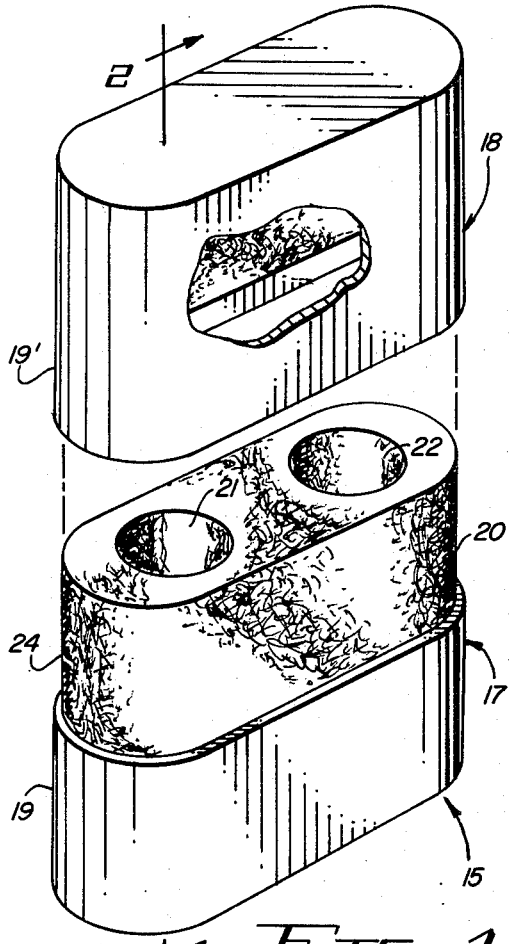
FIG. 1 is a perspective view of an insulating baby bottle carrier comprising telescopic parts and embodying the invention.
Figure 2:
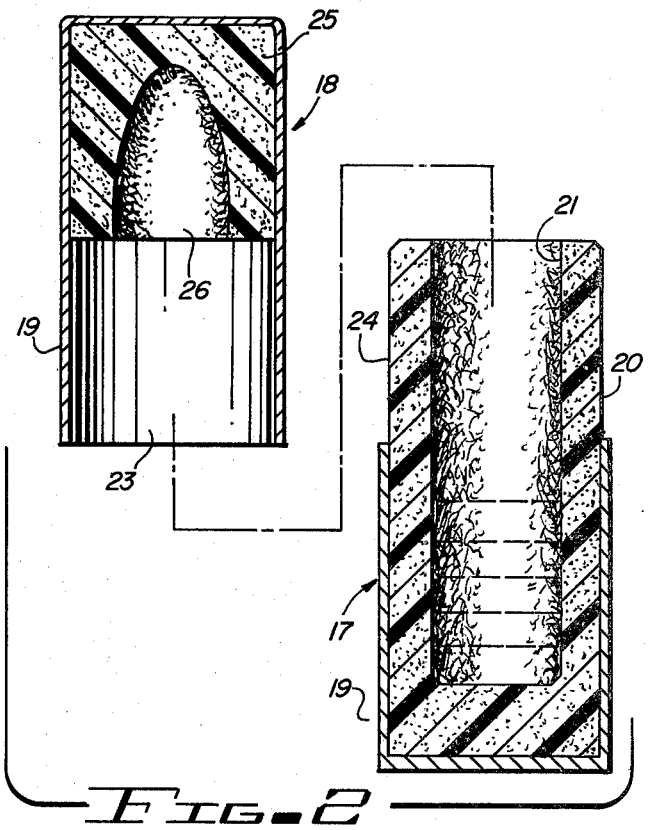
FIG. 2 is a cross-sectional view of FIG. 1 taken along the line 2—2.
Figure 10:
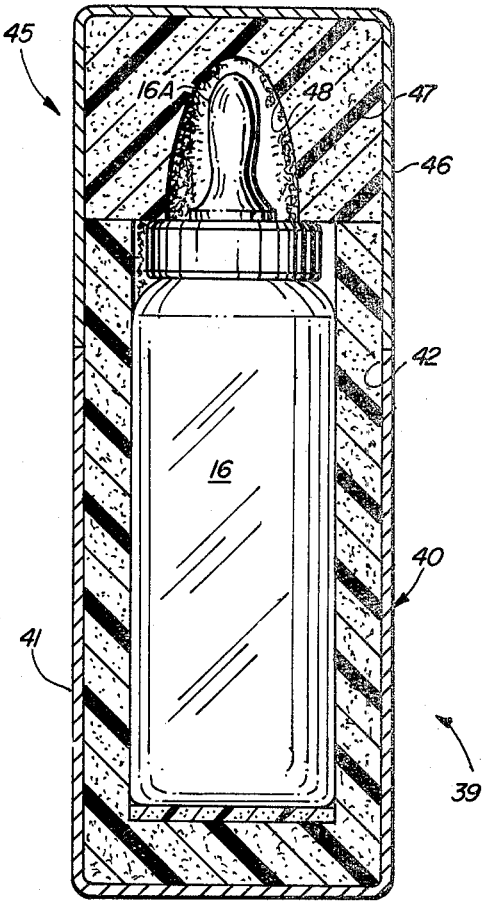
FIG. 10 is a cross-sectional view of the carrier shown in FIG. 9 with the carrier encasing a baby bottle.
Figure 13:
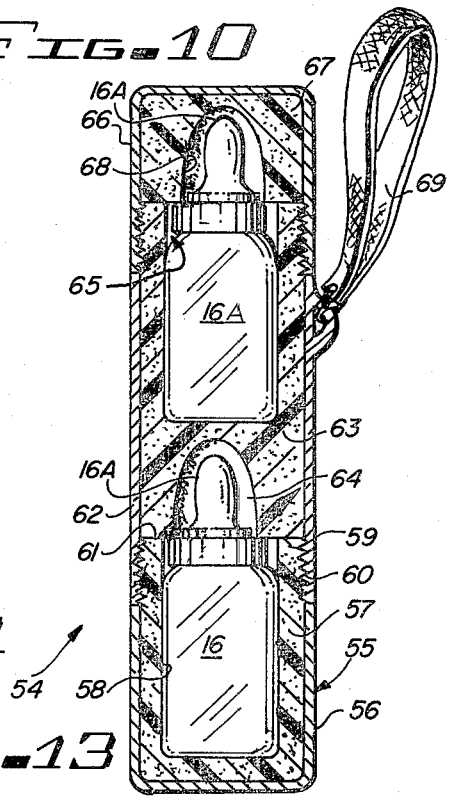
FIG. 13 is a cross-sectional view of a further modification of the carriers shown in FIGS. 1, 3, 9, 10 and 12 wherein two cylindrical carrier parts are vertically arranged in a detachable manner to form an integrated carrier structure.

Referring more particularly to the drawings by characters of reference, FIGS. 1 and 2 disclose an insulating carrier 15 for baby bottles 16 arranged in their nipple extended positions as shown in FIGS. 10 and 13 and comprising a base portion 17 and a telescopically fitting cover or top portion 18. The carrier 15 comprising its portions 17 and 18 may be formed with outer casing 19, 19' of hard, smooth, molded plastic formed in an oblong configuration having inserted or molded therein a porous plastic insert 20. Insert 20 is provided with two positioned cavities 21 and 22 formed therein to extend longitudinally thereof. These cavities are of a size to snugly fit in a conforming manner around one or two baby bottles so as to insulate it and preserve for a period of time the temperature of their contents.

As shown in FIGS. 1 and 2, the top or cover portion 18 of the carrier comprises the outer casing 19' which defines an open end 23 which is arranged to telescopically fit around the upper exposed portion 24 of insert 20 positioned in the lower casing 19 of the carrier 15. The closed top inner part of portion 18 of the carrier is filled with a plastic insert or material 25 which is provided with a cavity 26 extending longtundinally thereof and opening outwardly into opening 23. This cavity is formed to receive the extended nipple of a baby bottle in a spacedly arranged manner as shown in FIG. 10.

Thus, an efficient insulating slim line carrier is shown in FIGS. 1 and 2 which may be easily inserted in the bag usually carried by a mother for later use without unduly filling or overloading the bag.

Figure 3:
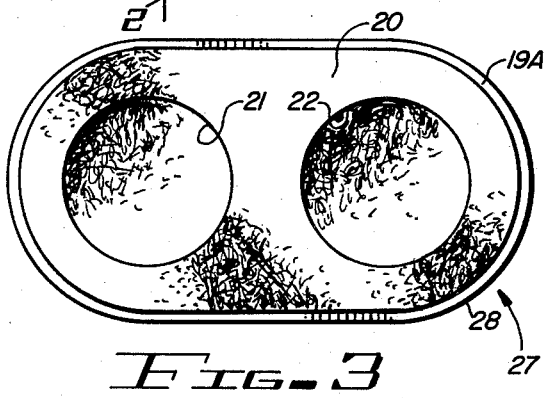
FIG. 3 is a top view of a modification of the base portion of the carrier shown in FIGS. 1 and 2 wherein the insulating shell of the carrier, shown in FIG. 1, extends along its full length.
Figure 4:
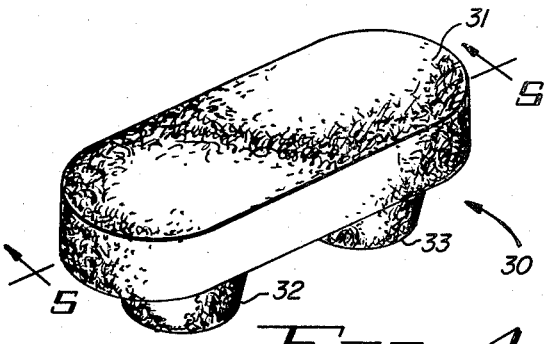
FIG. 4 is a perspective view of a detachably mounted top for the base of the carrier shown in FIG. 3.
Figure 5:
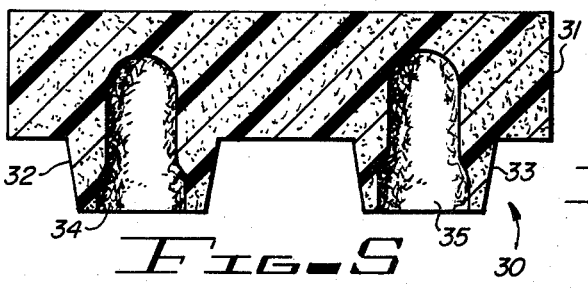
FIG. 5 is a cross-sectional view of FIG. 4 taken along the line 4—4.
Figure 6:
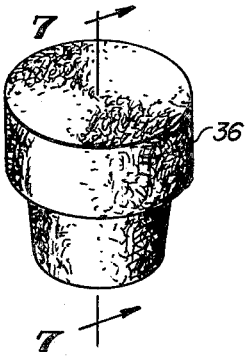
FIG. 6 is a perspective view of a single individual top for the carrier base shown in FIG. 3.
Figure 7:
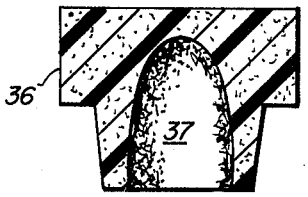
FIG. 7 is a cross-sectional view of FIG. 6 taken along the line 7—7.

FIGS. 3–5 disclose a modification of the carrier shown in FIGS. 1 and 2 wherein the carrier 27 comprises an oblong base portion 28 with the hard, smooth plastic shell 19A encircling and surrounding the bottom and sides of the base portion. This bottom portion is similar to that shown in FIGS. 1 and 2 except that in encases minus its top the insulating porous plastic insert 20. The cavities 21 and 22 are identical to those shown in FIGS. 1 and 2 closely conforming to the geometrical configuration of the bottle portion of the baby bottles 16. The top portion 30 of the carrier 27 comprises the oblong plate 31 having two cap portions 32 and 33 extending therefrom for fitting into the open ends of the cavities 21 and 22. Cap portions 32 and 33 are provided with cavities 34 and 35, respectively, which extend up into plate 31 each forming the outline of the nipple of a baby bottle. FIGS. 6 and 7 disclose a modification of the top portion 30 of the carrier 27 shown in FIGS. 3—5 wherein the individual cap 36 and its internal cavity 37 may be used to cover and protrude into one or the other of the cavities 21 and 22 of the base portion 27, or two of them may be used to cover both cavities.

Figure 8:
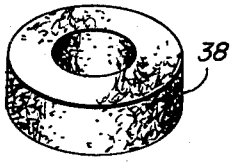
FIG. 8 is a perspective view of a circular disc which could be used with the structure of FIG. 3 to make it adaptable for receiving the top portion of the carrier shown in FIG. 1.

FIG. 8 discloses a disc shaped insert 38 which may be used to fit around the neck of a bottle 16 placed in the base 28 of carrier 27, thereby rendering it acceptable for receiving as a top the top portion 18 of carrier 15.

Figure 9:
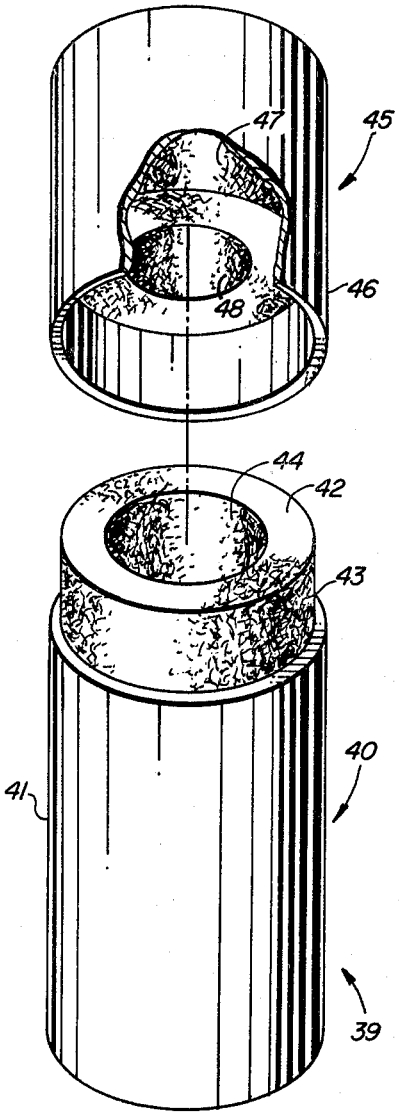
FIG. 9 is a perspective exploded view of a cylindrical insulated carrier for a baby bottle having a form fitting cavity for receiving the bottle in nipple extended position.

FIGS. 9 and 10 disclose a further modification of the carriers shown in FIGS. 1 and 3 wherein the cylindrical carrier 39 comprises a bottom portion 40 having a cylindrical smooth surfaced plastic shell 41 surrounding a porous plastic cylindrical linning or hollow sleeve 42 inserted therein with a portion 43 thereof extending outwardly of the shell's open end 44. A cylindrical cover portion 45 of the carrier 39 is provided for telescopically fitting over portion 43 of sleeve 42 such that its outer shell 46 fits against the open end of shell 41 in axial alignment therewith. An apertured insert 47 is arranged in the closed end of cover portion 45, as shown in FIG. 10, and provided with a cavity 48 for fitting over and around the nipple 16A of the baby bottle 16. When the cap portion 45 is tightly fitted over the end of the associated bottom portion the shells 41 and 46 are juxtapositioned and in axial alignment to provide a smooth surfaced, porous lined conforming carrier for baby bottles having their nipples in extended ready to use arrangement.

Figure 11:
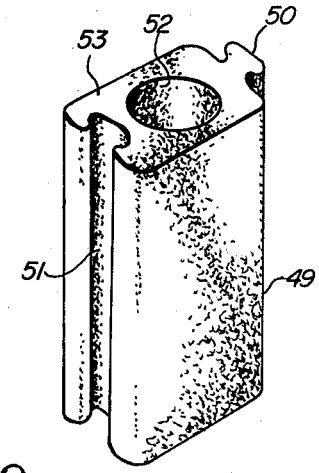
FIG. 11 is a perspective view of a modification of the carriers shown in FIGS. 1, 3, 9 and 10 wherein the carrier is formed to deteachably interconnect with other similar carriers to form a single larger carrier configuration.
Figure 12:
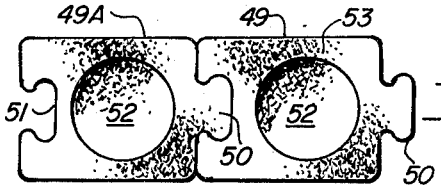
FIG. 12 is a top view of two interconnected carriers of the type shown in FIG. 11.

FIGS. 11 and 12 disclose a further modification of the carrier shown in FIGS. 1, 2, 3, 9 and 10 wherein an interlocking carrier portion or member 49 is shown comprising a rectangular configuration having a tongue 50 and groove 51 extending longitudinally of opposite sides thereof. A cavity 52 is arranged to extend into its interior from the top 53 thereof and having a shape to conform to the shape of the bottle portion of the baby bottle 16 shown in FIG. 10. As shown in FIG. 12 two or more members 49–49A may be interlocked together to form at the option of the user a two or more cavity carrier. Each of the openings of the cavities 52 may be closed by a cap 36 of the type shown in FIG. 6.

FIG. 13 discloses a further modification of the carriers shown in FIGS. 1, 2, 3, 9, 10, 11 and 12 wherein the carrier 54 comprises an elongated cylindrical housing having a lower or bottom portion 55 encased by a closed ended shell 56 that houses an insulating plastic sleeve 57 that is provided with a cavity 58 for closely surrounding a baby bottle 16. The top part 59 of sleeve 57 extends out of bottom portion 55 of the carrier and is provided with a threaded configuration 60 around its outer periphery for engaging with the internal threads 61 of an open ended top portion or shell 62. Shell 62 is further provided with a cylindrical plastic insert 63 provided with two cavities 64 and 65. Cavity 64 is intended to receive the nipple of the bottle 16 placed in cavity 58 of sleeve 57 while cavity 65, is intended to receive the bottle portion of a second baby bottle 16A. The outer periphery of the upper end of insert 63 is threaded, as shown, for threadedly receiving a cap 66 of the carrier 54. This cap is provided with an insert 67 having a cavity 68 for receiving the nipple of baby bottle 16A. A suitable strap 69 may be attached to the side of carrier 54 for aid in holding the carrier.

It should be noted that either end of the carrier may be opened independently of the other to remove one of the baby bottles. This may be done without destroying the insulated condition of the other baby bottle.

Although but a few embodiments of the present invention have been illustrated and described, it will be apparent to those skilled in the art that various changes and modifications may be made therein without departing from the spirit of the invention or from the scope of the appended claims.

What is claimed is:

1. An insulated baby bottle carrier comprising:

an elongated housing having a bottom portion and a cap interconnected by an open ended hollow shell, an insulating porous sleeve fitted into said bottom portion and defining a first cavity extending longitudinally thereof for receiving in a snugly fitting arrangement the bottle portion of a first baby bottle, said shell being provided internally thereof with an elongated insulating insert which is provided with second and third cavities one extending into each end thereof, said second cavity being positioned and conformed to receive the extended nipple of the first baby bottle when positioned in said porous sleeve and when said shell is engaged with said bottom portion, the third cavity being formed to receive the bottle of a second baby bottle, and an insert mounted within said cap and provided with a cavity, the cavity of said cap being positioned and conformed to receive the extended nipple of a second baby bottle positioned in said third cavity of said shell.

2. The insulated baby bottle carrier set forth in claim 1 wherein:

said top and bottom portions and said shell comprise cylindrical configurations.

3. The insulated baby bottle carrier set forth in claim 1 wherein:

said insulated sleeve extends outwardly of said bottom portion, and said shell fits around and engages with the portion of said sleeve extending outwardly of said bottom portion.

4. The insulated baby bottle carrier set forth in claim 1 wherein:

said bottom portion, shell and the top are formed of one type of plastic, and said sleeve and said insert are formed of a porous plastic material.

5. The insulated baby bottle carrier set forth in claim 1 wherein:

said bottom portion, sleeve and cap are axially aligned.

6. The insulating baby bottle carrier set forth in claim 1 wherein:

said cap and said bottom portion are threadedly attached to said sleeve.

7. The insulated baby bottle carrier set forth in claim 1 wherein:

said housing has a smooth outer surface.

* * * * *